US007097592B2

(12) United States Patent
Wang

(10) Patent No.: US 7,097,592 B2
(45) Date of Patent: Aug. 29, 2006

(54) OVAL-TRACKED EXERCISE APPARATUS WITH AN ADJUSTABLE EXERCISE TRACK (I)

(76) Inventor: Leao Wang, No. 1, Lane 233, Sec. 2, Charng Long Rd., Taiping (TW) 411

( * ) Notice: Subject to any disclaimer, the term of this patent is extended or adjusted under 35 U.S.C. 154(b) by 0 days.

(21) Appl. No.: 11/046,029

(22) Filed: Jan. 31, 2005

(65) Prior Publication Data

US 2006/0172863 A1 Aug. 3, 2006

(51) Int. Cl.
*A63B 22/06* (2006.01)
*A63B 22/04* (2006.01)

(52) U.S. Cl. ..... 482/52; 482/57

(58) Field of Classification Search ..... 482/51–53, 482/57, 70, 79–80
See application file for complete search history.

(56) References Cited

U.S. PATENT DOCUMENTS 5,685,804 A * 11/1997 Whan-Tong et al. ..... 482/51
6,007,462 A * 12/1999 Chen ..... 482/57
6,030,320 A * 2/2000 Stearns et al. ..... 482/57
6,042,512 A * 3/2000 Eschenbach ..... 482/52
6,217,485 B1 * 4/2001 Maresh ..... 482/52
6,648,801 B1 * 11/2003 Stearns et al. ..... 482/52
6,846,273 B1 * 1/2005 Stearns et al. ..... 482/52

* cited by examiner

*Primary Examiner*—Stephen R. Crow

(57) ABSTRACT

An oval-tracked exercise apparatus with an adjustable exercise track having a frame unit consisting of an upright frame and a base frame. A hanging handlebar is provided at both sides of the upright frame. One end of two planks is pivotally attached to the bottom end of the handlebars while the other end thereof moves up and down in alternating succession above the base frame. In this way, an oval walking track can be simulated in treading the treadles. The upright frame is rotatably attached to the base frame to undergo an adjustment to an inclined position at a certain angle. Moreover, a connecting rod between the upright frame and the base frame passes through a position-limiting tube to form an adjusting mechanism, whereby both handlebars are synchronically adjustable to allow the simulation of an oval exercise track in uphill or downhill position.

3 Claims, 5 Drawing Sheets

OVAL-TRACKED EXERCISE APPARATUS WITH AN ADJUSTABLE EXERCISE TRACK (I)

BACKGROUND OF THE INVENTION

1. Fields of the Invention

The invention relates to an oval-tracked exercise apparatus, and more particularly, to an exercise apparatus in which the oval track movement is adjustable to allow the simulation of walking exercise in an uphill or a downhill position.

2. Description of the Related Art

A conventional oval-tracked exercise apparatus includes a main body consisting of an upright frame and a base frame both of which are connected to each other. Two planks each have one end pivotally connected with a corresponding handlebar and the other end connected with a crank to create an alternating movement. In treading treadles on the planks, an oval track movement can be simulated for the purpose of taking a jogging exercise In order to facilitate the swing movement of the operator's hands during the exercise session, handlebars are provided for simulating the walking action. As shown in FIG. 5, TW 86218424 teaches an oval-tracked exercise apparatus that includes a main body consisting of a lower frame A01 and an upper frame A02. The upper frame A02 and an auxiliary frame A03 are attached to a cross bar A21. A front upright tube A23 is pivotally connected to each end of the cross bar A21. Moreover, a connecting rod A12 with one treadle A11 is pivotally connected to the bottom end of the hanging tubes A23. The bottom end of each treadle A11 is positioned on a crank A14 of a flywheel A13 rotatably mounted on the lower frame A01. In this way, an oval exercise tract can be simulated for an up-and-down movement in alternating succession. A handlebar A22 is received within each of the front upright tubes A23; meanwhile, its length is adjustable according to the height of the operator. The handlebars A22 can be gripped by the operator's hands during the exercise session to keep his balance.

Moreover, another oval-tracked exercise apparatus has been developed for simulating a walking exercise in uphill or downhill position. As shown in FIG. 6, TW 86218424 teaches an oval-tracked exercise apparatus that includes a main frame consisting of an upright frame B01 and a base frame B02. A handlebar B22 is pivotally connected to the right and the left side of the upright frame B01. Meanwhile, the hanging handlebars B22 are pivotally attached to the adjusting rods B21 and the connecting rods B12 with treadles B11. The distal end of the adjusting rods B21 is in connection with the slide rod B23 while the front end of the slide rod B23 is mounted on cranks B14 of a flywheel B13 rotatably fitted to the base frame B02. In addition, rollers B24 are slid ably mounted on the base frame B02. The angle of the slide rod B23 is adjustable by the adjusting rods B21 on the handlebars B22. In this way, the walking exercise in uphill or downhill position can be indirectly simulated due to the change of the angle when the treadles B11 move on the slide rod B23 in an oval exercise track.

As shown in FIG. 7, TW 92220374 teaches still another oval-tracked exercise apparatus that includes a main frame consisting of an upright frame C01 and a base frame C02. A handlebar C22 is pivotally connected to the right and the left side of the upright frame C01 in a hanging state. One end of two planks C12 is adjustably attached to the corresponding handlebar C22 while the other end thereof is mounted on cranks C14 of a flywheel C13 rotatably attached to the base frame C02. In treading the planks C12, both planks C12 will move up and down in alternating succession under the influence of the crank C14, thereby simulating an oval walking track. Also, the uphill and the downhill walking state can be synchronically simulated by adjusting the position of the adjusting member C21 on the handlebar C22.

From the above-mentioned development of the oval-tracked exercise apparatus, we may find a common drawback that an adjustment along the handlebar must be carried out to achieve a desired walking exercise in uphill or downhill position. In this way, the right and the left handlebar each have to be carefully adjusted in changing the walking exercise in uphill or downhill position for achieving the balance sense during the exercise session. This wastes, however, much time and effort.

SUMMARY OF THE INVENTION

It is a primary object of the invention is to provide an exercise apparatus having a frame unit consisting of an upright frame and a base frame. A hanging handlebar is provided at both sides of the upright frame. One end of two planks is pivotally attached to the bottom end of the handlebars while the other end thereof moves up and down in alternating succession above the base frame. In this way, an oval walking track can be simulated in treading the treadles. The upright frame is rotatably attached to the base frame to undergo an adjustment to an inclined position at a certain angle. Moreover, a connecting rod between the upright frame and the base frame passes through a position-limiting tube to form an adjusting mechanism, whereby both handlebars are synchronically adjustable to allow the simulation of an oval exercise track in uphill or downhill position.

Another object of the invention is to provide an exercise apparatus that can synchronically adjust the planks at both sides to simulate the oval tracked walking exercise in uphill and downhill position for achieving balance during the exercise session.

A further object of the invention is to provide an exercise apparatus in which the upright frame is adjustable in inclined position for a curved swing movement to allow the change of the hanging state of the handlebars in relation to the planks.

BRIEF DESCRIPTION OF THE DRAWINGS

The accomplishment of this and other objects of the invention will become apparent from the following description and its accompanying drawings of which.

DETAILED DESCRIPTION OF THE PREFERRED EMBODIMENT

Figure 1:
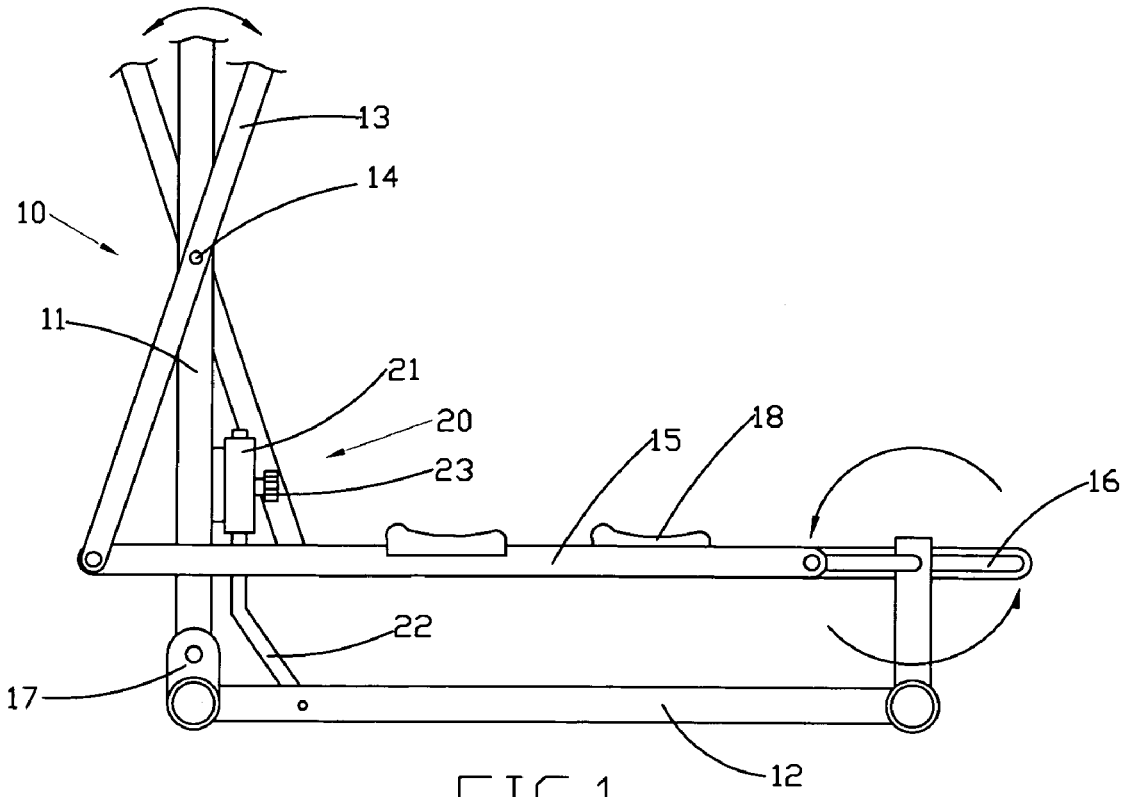
FIG. 1 is a schematic drawing of an oval-tracked exercise apparatus of the invention with a manually operated adjusting mechanism.

Referring to FIG. 1, a frame unit 10 consists of an upright frame 11 and a base frame 12. Two handlebars 13 are attached to the right and the left side of the upright frame 11, respectively, and they are freely swingable at a hinge joint 14. Two planks 15 each have one end pivotally connected with the corresponding handlebar 13 and the other end connected with a crank 16 to create an up-and-down movement in alternating succession. In treading the treadles 18, an oval track movement can be simulated for the purpose of taking a jogging exercise.

The base frame 12 includes a base 17 with which the upright frame 11 is pivotally connected. A position-limiting tube 21 is mounted on the upright frame 11, and a connecting rod 22 pivotally mounted on the base frame 12 projects from the position-limiting tube 21. A plurality of grooves or holes is optionally provided in the connecting rod 22. The design without grooves or holes is also possible. A fixing bolt 23 can be employed to fix the connecting rod 22 within the position-limiting tube 21 in position, thereby forming a complete adjusting mechanism 20.

Figure 2:
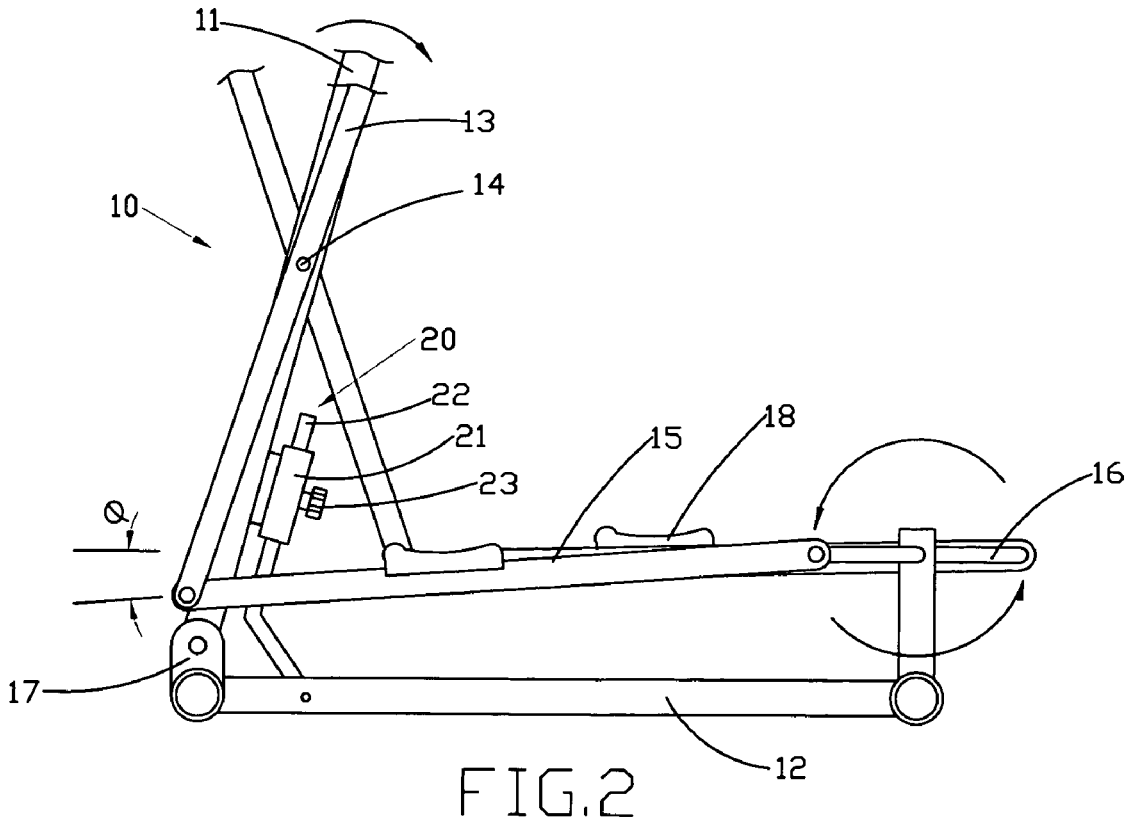
FIG. 2 is a schematic drawing of the oval-tracked exercise apparatus of the invention of FIG. 1, showing that the upright frame swings clockwise.
Figure 3:
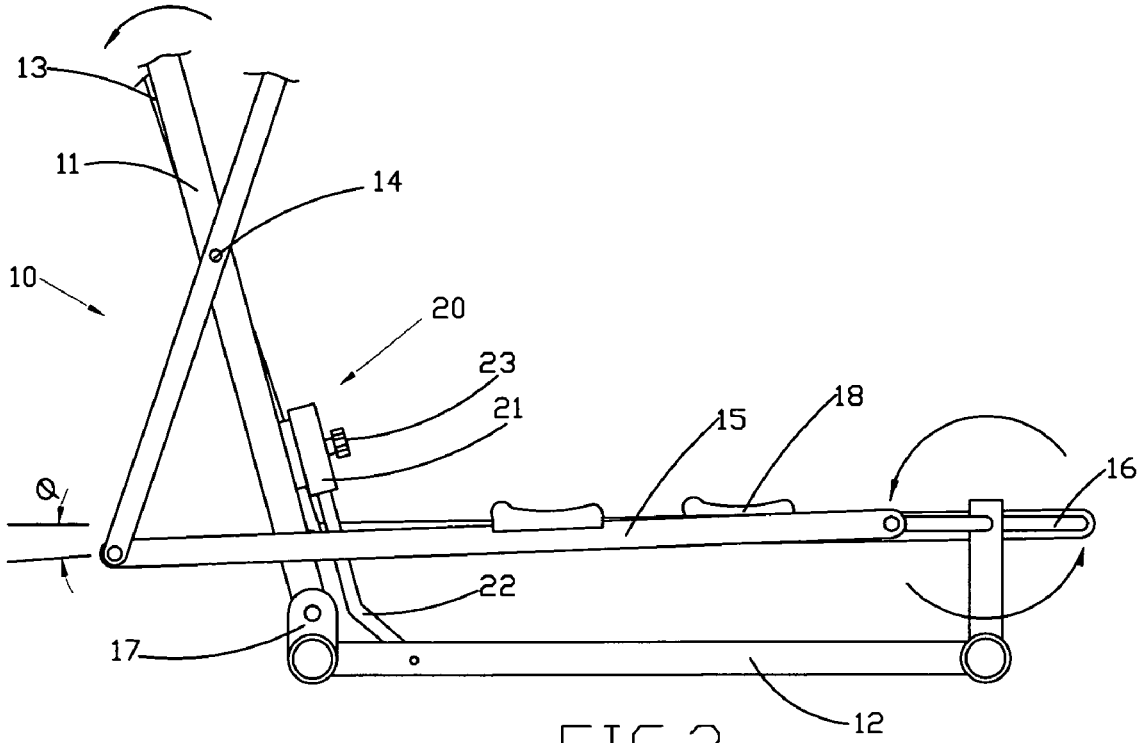
FIG. 3 is a schematic drawing of the oval-tracked exercise apparatus of the invention of FIG. 1, showing that the upright frame swings counterclockwise.

The above-mentioned mechanism 20 is manually operated. As shown in FIGS. 2 and 3, when the fixing bolt 23 is loosened, the upright frame 11 can be swiveled clockwise or counterclockwise in relation to the base 17. Meanwhile, the position-limiting tube 21 is synchronically moved to allow the connecting rod 22 to shift in the position-limiting tube 21. At that time, the fixing bolt 23 can be tightened to fix the connecting rod 22 in place. So, the step of the manual control of the upright frame 11 in an inclined position is completed.

After the upright frame 11 is manually fixed in place, the direction of the hinge joint 14 will be changed with the upright frame 11. Accordingly, both handlebars 13 rotatably movable on the hinge joint 14 are synchronically shifted to a new position. So, the planks 15 are inclined at an angle of $\theta$ relative to the original position. When the operator treads on the treadles 18 again, the planks 15 can simulate not only an oval track movement, but also a walking exercise in uphill and downhill position due to the formation of the angle of $\theta$.

Figure 4:
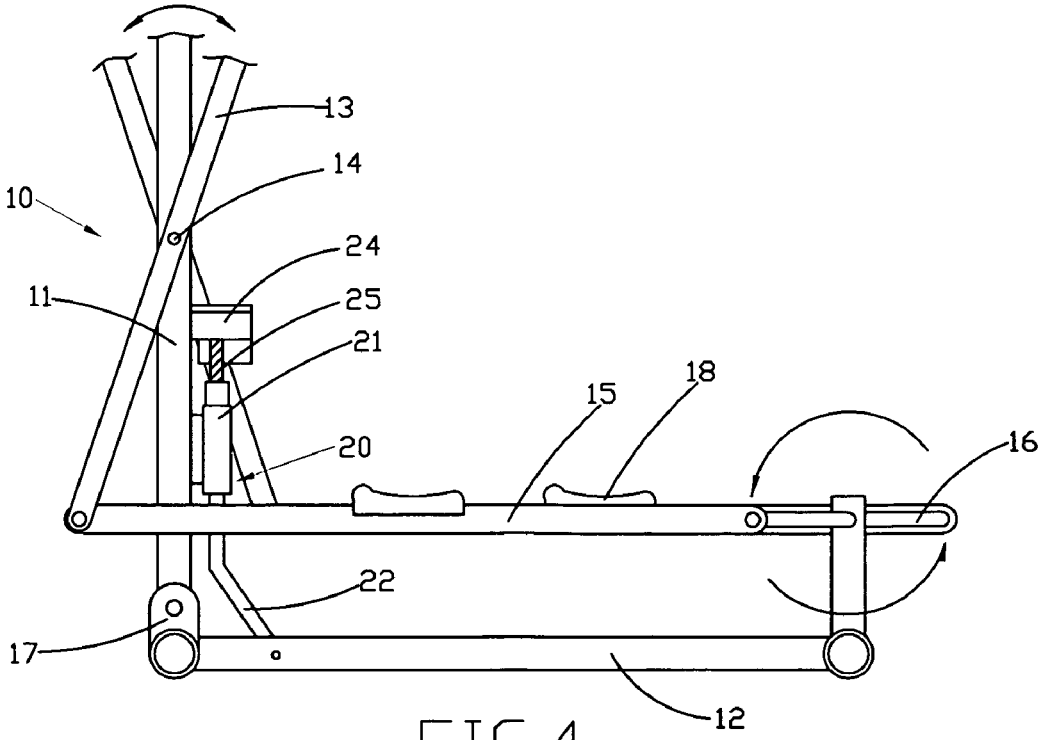
FIG. 4 is a schematic drawing of an oval-tracked exercise apparatus of the invention with an automatically operated adjusting mechanism.
Figure 5:
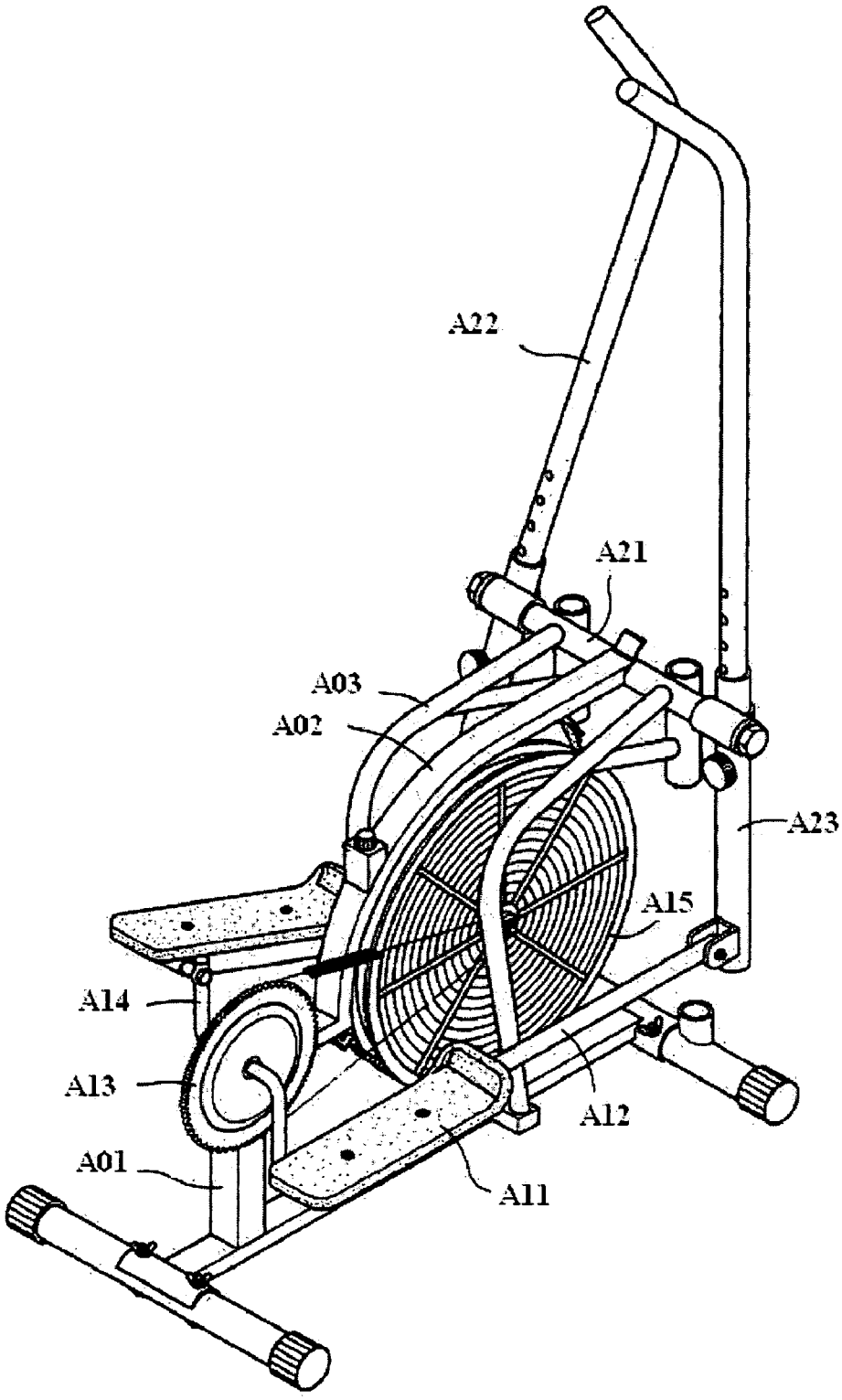
FIG.5 PRIOR ART
FIG. 5 is a perspective exploded view of a conventional oval-tracked exercise apparatus.
Figure 6:
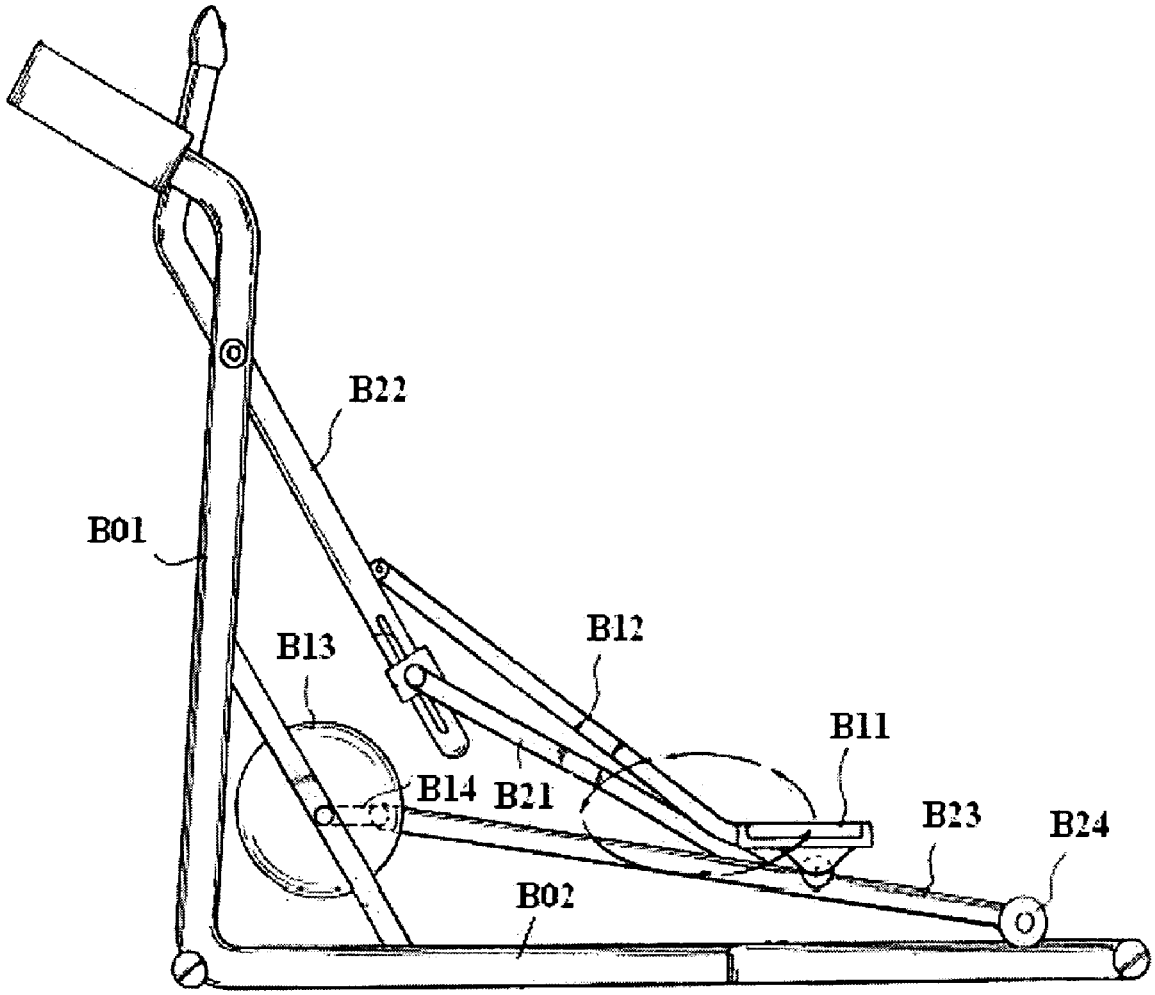
FIG.6 PRIOR ART
FIG. 6 is a side view of another conventional oval-tracked exercise apparatus.
Figure 7:
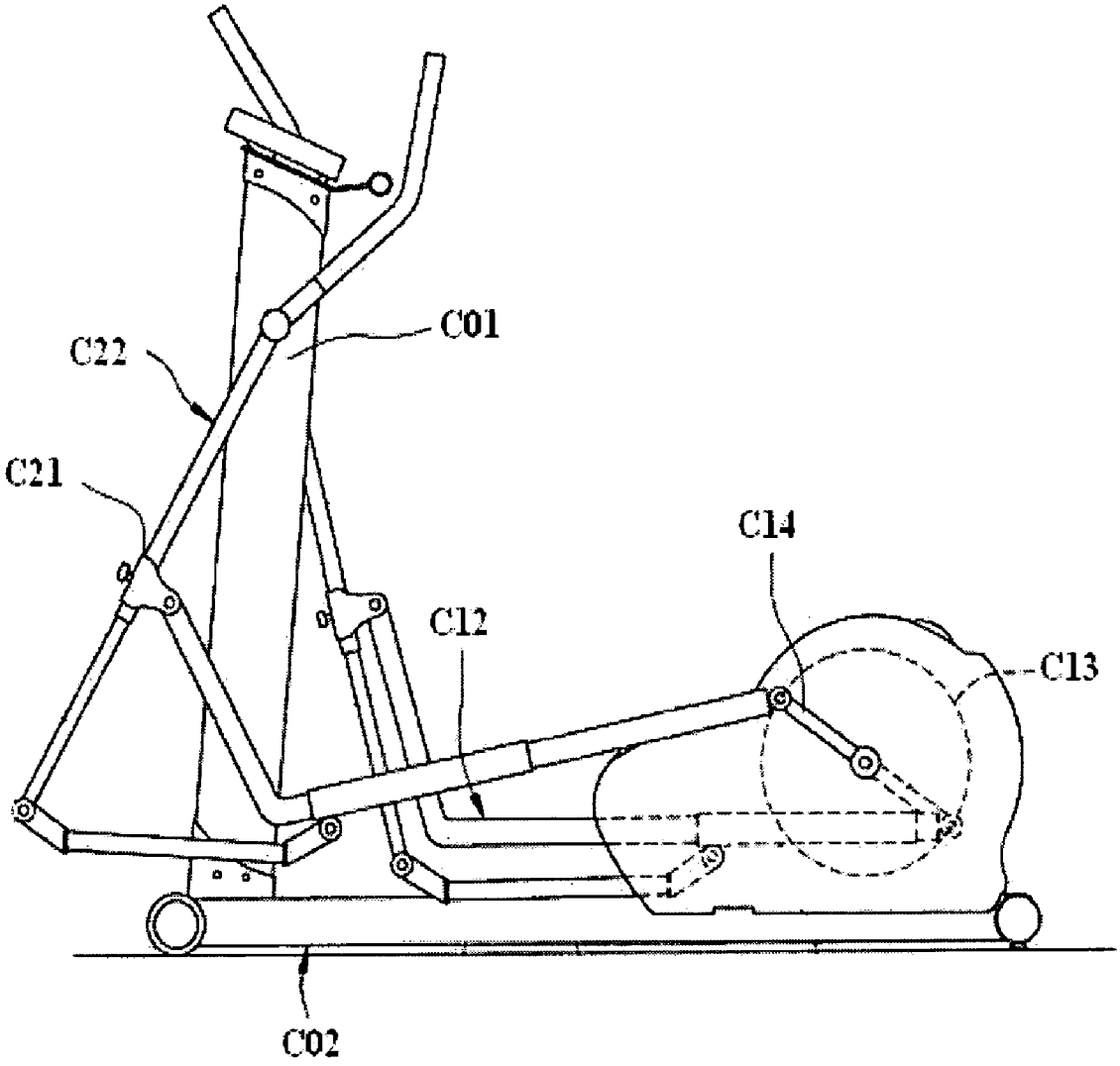
FIG.7 PRIOR ART
FIG. 7 is a side view of a further conventional oval-tracked exercise apparatus.

FIG. 4 illustrates an adjusting mechanism 20 operated in automatic mode. Similarly, a position-limiting tube 21 is fitted to the upright frame 11, and a connecting rod 22 pivotally attached to the base frame 12 projects from the position-limiting tube 21. Also, the connecting rod 22 is provided with a plurality of grooves and holes, and the design without the grooves and holes is possible as well. However, the difference lies in that a driving element 24 is disposed on the top of the position-limiting tube 21 through a motor-driven spindle 25. The spindle 25 is rotatably coupled with the connecting rod 22. In this way, the operator can activate the spindle 25 of the driving element 24 via an electronic console (not shown) to extend or retract so that the connecting rod 22 is movable in the position-limiting tube 21 with the extending and retracting action of the spindle 25. Meanwhile, the upright frame 11 is swivelable about the base 17 to different inclined positions shown in the FIGS. 2 and 3.

Since the adjusting mechanism 20 in the automatic mode is operated on the same principle as that in the manual mode, no further descriptions thereto are given hereinafter.

Therefore, the advantages of the aforementioned apparatus in contrast to the conventional one can be concluded as follows:

1. The planks 15 at both sides are adjustable to allow a simulation of an oval-tracked walking exercise in uphill or downhill position. So, a balance during the exercise session is achieved.
2. Unlike the prior art that the handlebars have to be adjusted individually, the adjustment of the angle of the upright frame 11 may be completed by only one curved swing action.
3. Unlike the prior art that requires a repeated adjustment, the invention requires only one adjustment to allow the connecting rod 22 to create the simulation of walking exercise in uphill or downhill position. Consequently, the operation of the invention is considerably simplified.

Many changes and modifications in the above-described embodiment of the invention can, of course, be carried out without departing from the scope thereof. Accordingly, to promote the progress in science and the useful arts, the invention is disclosed and is intended to be limited only by the scope of the appended claims.

What is claimed is:

1. An elliptical exercise apparatus with an adjusting mechanism having a frame unit consisting of an upright frame and a base frame, a hanging handlebar being provided at both sides of the upright frame, one end of two planks being pivotally attached to the bottom end of the handlebars while the other end thereof is attached to a crank configured so that the other end moves up and down in alternating succession above the base frame, wherein the upright frame is pivotally attached to the base frame to undergo an adjustment to an inclined position at an certain angle, and wherein a connecting rod between the upright frame and the base frame passes through a position-limiting tube to form an adjusting mechanism, whereby both handlebars are synchronically adjustable to allow the simulation of an exercise track in uphill or downhill position.

2. The elliptical exercise apparatus of claim 1 wherein the adjusting mechanism further includes a bolt on the position-limiting tube for fixing the connecting rod in place within the position-limiting tube so that the adjusting mechanism is manually operated.

3. The oval-tracked elliptical exercise apparatus of claim 1 wherein the adjusting mechanism further includes means for driving a spindle in connection with the connecting rod, and wherein the spindle is adapted to move the connecting rod in the position-limiting tube to a prearranged position while the upright frame is synchronically swiveled to a preset angle so that the adjusting mechanism is automatically operated.

* * * * *